United States Patent [19]

Roche

[11] 4,319,600

[45] Mar. 16, 1982

[54] UMBRELLA

[76] Inventor: Hugo Roche, c/o M. O'Leary, P.O. Box 274, Worcester, Mass. 01601

[21] Appl. No.: 179,951

[22] Filed: Aug. 21, 1980

[51] Int. Cl.[3] ..... A45B 25/22; A45B 23/00

[52] U.S. Cl. ..... 135/20 M

[58] Field of Search ..... 135/20 R, 20 M, 35

[56] References Cited

U.S. PATENT DOCUMENTS 2,595,697 5/1952 Pereira ..... 135/20 M 2,721,569 10/1955 Militano ..... 135/20 M

FOREIGN PATENT DOCUMENTS 2236149 2/1974 Fed. Rep. of Germany ... 135/20 M 2353967 5/1974 Fed. Rep. of Germany ... 135/20 M

*Primary Examiner*—J. Karl Bell

*Attorney, Agent, or Firm*—Blodgett & Blodgett

[57] ABSTRACT

Umbrella having mechanism to cause the canopy to fold when subjected to extraordinary wind forces.

7 Claims, 11 Drawing Figures

17
10
13
24
16
14

19
17
18
28
27
11

11
17
18
28
19
27
22
11
21
15

38
22
20
21
15
30
11

12

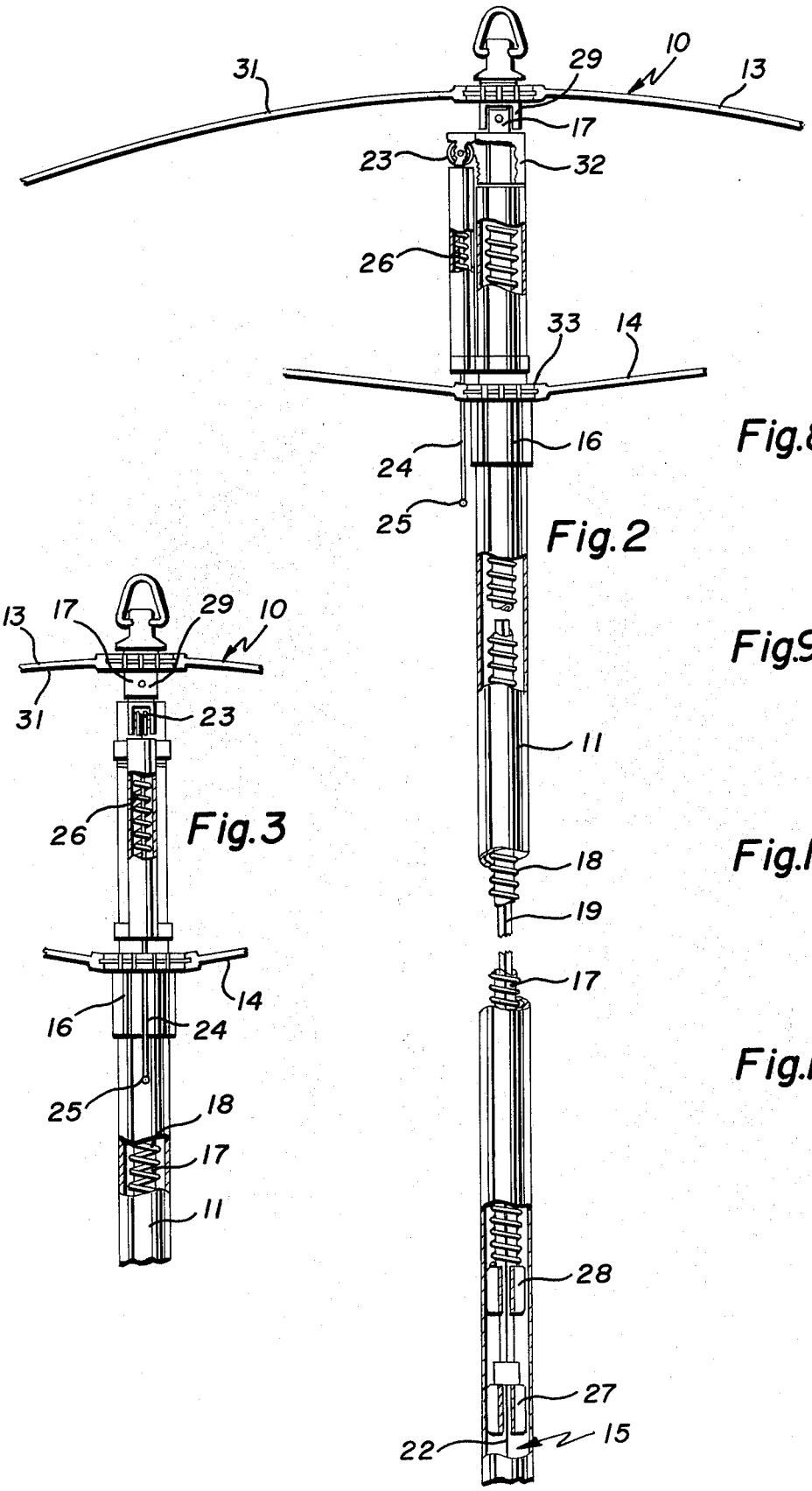
Fig.2
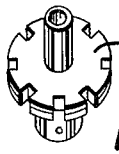
Fig.7
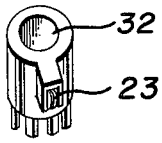
Fig.8
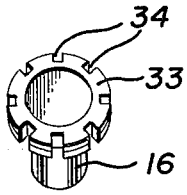
Fig.9
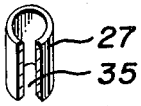
Fig.10
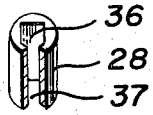
Fig.11
Fig.3

UMBRELLA

BACKGROUND OF THE INVENTION

It is common practice, particularly in areas adjacent to the ocean, to provide large umbrellas for shade. For instance, resort hotels commonly provide a series of these umbrellas that are semi-permanently mounted in a patio facing the ocean. Tables and chairs and the like are located under the umbrellas for the convenience of the hotel guests. The post for each umbrella may be located in a socket formed in the ground or in the patio floor. The canopy is folded at night and raised again in the morning by means of a hand crank. However, because such umbrellas are so large, they are particularly suspectible to the action of the wind. Even on a relatively calm day, a strong gust of wind can lift the umbrella out of its socket and project it through the air. Such umbrellas are expensive, so that repairing or replacing them can be quite costly. In addition, the accident can take place when there are people in the vicinity and they can be injured by the flying umbrella. Additionally, expensive damage can be caused to other adjacent equipment when the accidental projection of the umbrella takes place. These and other difficulties experienced with the prior art devices have been obviated in a novel manner by the present invention.

It is, therefore, an outstanding object of the invention to provide an umbrella which, when acted upon by a gust of wind, folds or collapses instead of flying through the air.

Another object of this invention is the provision of an umbrella constructed so that the wind causes it to fold to a limited extent when subjected to wind forces.

A further object of the present invention is the provision of a large umbrella for the beach or the like which wind will not project through the air to cause damage to itself or to persons in the vicinity.

It is another object of the instant invention to provide an automatically collapsing umbrella which is simple in construction, which is inexpensive to manufacture, and which is capable of a long life of useful service with a minimum of maintenance.

A still further object of the invention is the provision of a large-size, semi-permanent umbrella which is safe to use even when strong gusts of wind are encountered.

With these and other objects in view, as will be apparent to those skilled in the art, the invention resides in the combination of parts set forth in the specification and covered by the claims appended hereto.

SUMMARY OF THE INVENTION

In general, the invention consists of an umbrella having a tubular main post which is adapted to be mounted in the ground in a vertical position and having a generally circular foldable canopy carried above the upper end of the main post. Braces serve to connect the canopy to a hub which is slidably mounted on an intermediate portion of the main post. Means is provided for moving the hub vertically along the post from a high position where the canopy is raised to a low position where the canopy is folded. An auxiliary post is slidably carried within the main post and the center of the canopy is connected to the upper end of the auxiliary post. A spring is carried between the main post and the auxiliary post to resist (but not prevent) upward movement of the auxiliary relative to the main post when wind acts on the canopy.

More specifically, the means for moving the hub contains a spring which allows the hub to move downwardly when wind acts on the canopy. The said means also contains a control rod for limiting the downward motion of the hub. The auxiliary post is tubular and a guide post lies within it and is keyed to it to prevent rotation of the canopy during wind movement.

BRIEF DESCRIPTION OF THE DRAWINGS

The character of the invention, however, may be best understood by reference to one of its structural forms, as illustrated by the accompanying drawings, in which:

FIG. 2 is an enlarged view of portions of the umbrella with parts broken away for clarity of presentation, FIG. 3 is a side elevational view of a portion of the umbrella taken from the lefthand side of FIG. 2, FIGS. 7–11 are perspective views of various elements of the umbrella.

DESCRIPTION OF THE PREFERRED EMBODIMENT

Figures 1, 4, 5, 6:
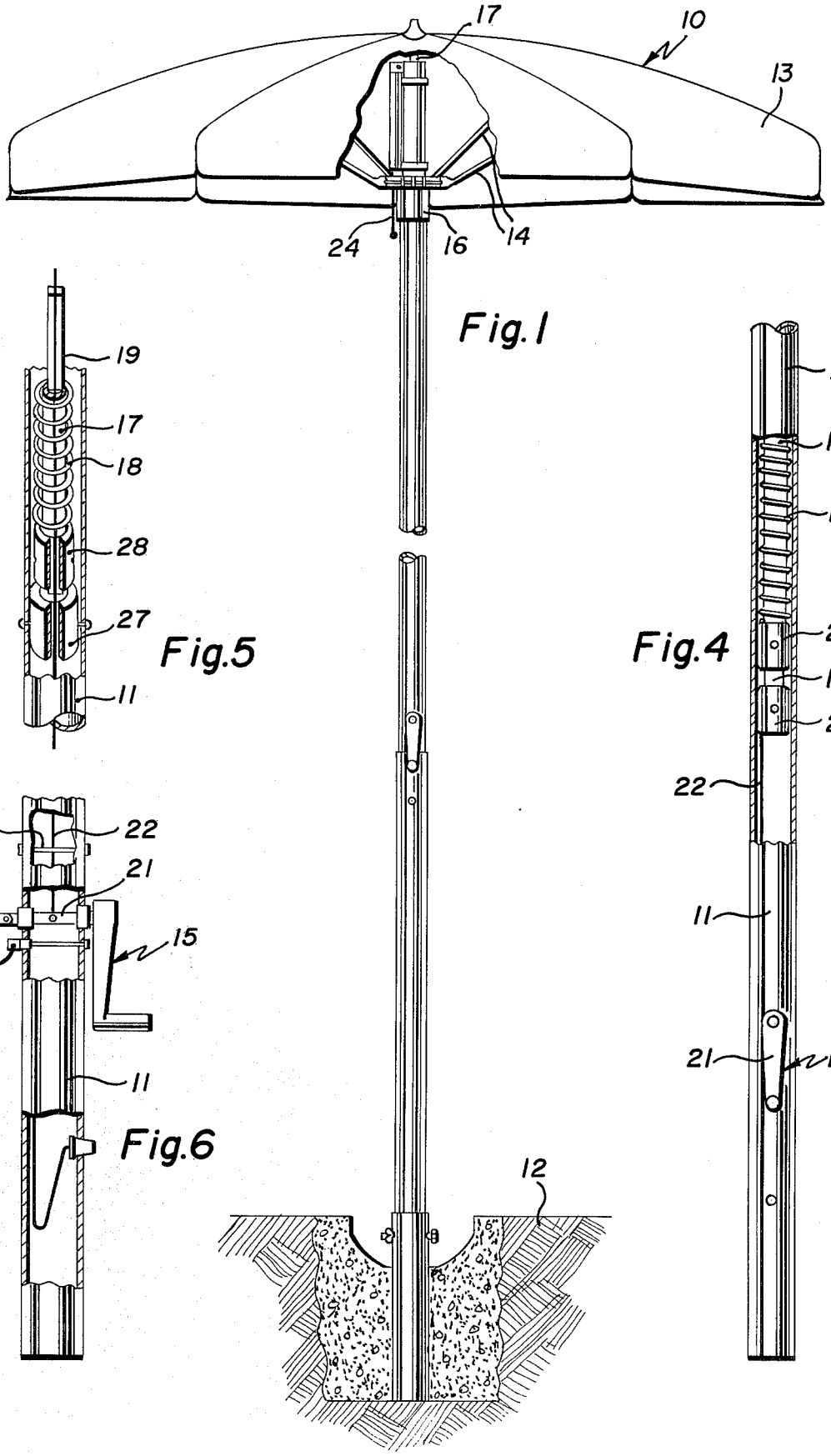
FIG. 1 is a front elevational view of an umbrella embodying the principles of the present invention.
FIG. 4 is a side elevational view of a portion of the umbrella with parts broken away to show the interior.
FIG. 5 is a perspective view of a portion of the umbrella showing the interior elements in the post.
FIG. 6 is a front elevational view of the lower part of the post with parts broken away to show the interior elements.

Referring first to FIGS. 1 and 2, wherein are best shown the general features of the invention, the umbrella, indicated generally by the reference numeral 10, is shown as having a tubular main post 11 adapted to be mounted in the ground 12 in a vertical position. A substantially circular foldable canopy 13 that is formed of a suitable fabric is carried above the upper end of the main post. Braces 14 serve to connect the canopy to a hub 16 that is slidably mounted on an intermediate portion of the post. An actuating means, indicated generally by the reference numeral 15, is provided for moving the hub vertically along the post from a high position where the canopy 13 is raised to a low position in which the canopy is folded.

An auxiliary post 17 is slidably mounted in the post 11 and extends substantially above the upper end thereof. The central portion of the canopy 13 is connected to the upper end of the auxiliary post. A spring 18 lies between the main post 11 and the auxiliary post 17 to resist upward movement of the auxiliary post when wind acts on the canopy.

FIG. 4 shows that a space is provided between the inner surface of the main post 11 and the outer surface of the auxiliary post 17 and it is in this space that the spring 18 is located. In this figure of the drawings and in FIG. 5 it can be seen that the auxiliary post 17 is tubular and carries within it a guide post 19. The guide post is fastened at its lower end to the main post, so that it does not move vertically or rotatively. It is keyed to the auxiliary post 17 in such a way that the latter cannot rotate, but is free to slide vertically.

FIG. 6 shows a crank-operated windlass 21 that is mounted at the lower end of the main post 11. A safety catch 20 in the form of a ring is hingedly attached to the external end of the windlass 21 and can be swung down after the umbrella is raised to loop around a pin 30 to prevent the accidental collapsing of the umbrella under wind pressure. A cord 22 extends from the windlass to the hub 16 and serves to move the hub from the low position to the high position and vice versa. A pulley 23 (see FIG. 3) is mounted at the upper end of the main post 11 to carry the cord 22 up over the upper edge of the post and downwardly to the hub. A rivet 38 prevents extreme friction of the cord 22 against other parts.

As best shown in FIGS. 2 and 3, a control rod 24 passes slidably through a vertical bore in a radial flange 33 on the hub 16. The rod has a stop 25 at its lower end. The cord 22 is attached to the upper end of the rod and a coil spring 26 under tension surrounds the control rod. The spring is fixed at its upper end to the upper end of the control rod, while its lower end is fixed to the hub 16 so that, when a strong wind strikes the canopy, the hub can be pushed downwardly against the spring tension.

Referring next to FIG. 5, the guide post 19 is shown as a tube of square cross-section and has its lower end fastened to a fixed plug 27 that is mounted within the main post 11 at its lower portion. A carrier plug 28 is slidably carried in the lower part of the main post above the fixed plug and the lower end of the auxiliary post 17 is fixedly attached to the carrier plug.

As is obvious in FIG. 2, a canopy hub 29 is mounted on the upper end of the auxiliary post 17 and ribs 31 are hingedly connected to that hub and extend radially outwardly therefrom to support the canopy 13. The details of the canopy hub 29 are shown in FIG. 7. FIG. 8 shows the details of a cap 32 which is mounted on top of the main post 11 to hold the pulley 23. FIG. 9 shows the details of the hub 16 and the manner in which is provided the radial flange 33 formed with slots 34 to receive the braces 14. FIG. 10 shows the fixed plug 27 in detail and shows the provision of a slot 35 to allow the passage of the cord 22 upwardly. FIG. 11 shows the details of the carrier plug 28 and the manner in which its square central passage 36 allows it to slide over the square guide post 19 without rotation. It is also provided with a slot 37 to allow the passage of the cord 22 passed it.

The operation and advantages of the invention will now be readily understood in view of the above description. With the umbrella 10 in the condition shown in FIG. 1, the main post 11 is mounted in the ground, possibly by insertion into a socket. The hub 16 is shown in its upper position, thus causing the braces 14 to raise the canopy 13 into the operative position where it acts to protect persons sitting under it from the sun or sometimes from the rain. If a strong gust of wind passes over the umbrella, it acts in two ways upon the assemblage. First of all, the wind under the canopy 13 causes the auxiliary post 17 to rise, thus causing the ribs 31 to lie at a lesser angle relative to it, so that the canopy 13 starts to fold. At the same time, the wind acts at the outer periphery of the canopy to push it downwardly and cause the hub 16 to move downwardly, so that the ribs 14 also tend to draw the canopy toward folded position. In other words, the auxiliary post 17 moves upwardly and the hub 16 moves downwardly, thus causing the canopy to start to fold. This causes the canopy to present less resistance to the flow of the wind and, therefore, prevents the wind from lifting the umbrella out of its socket and causing it to fly through the air. The motion of the auxiliary post 17 upwardly is resisted by the coil spring 18. The square shape of the guide post 19 prevents the canopy from rotating in the wind, even though it allows the auxiliary post 17 to move upwardly and downwardly as the wind pressure causes it. The spring 26, of course, acts on the hub 16 to cause it to tend to stay in its high position. When the hub 16 moves downwardly, it may move downwardly until it strikes the stop 25 on the end of the control rod 24. Thus, the spring 26 is always strong enough to return the hub to its high position (canopy extended) when the wind strength is diminished. When one wishes to fold up the umbrella during the night, it is only necessary to rotate the capstan 21 to introduce slack into the cord 22 and this allows the hub 16 to move downwardly to fold up the canopy.

It can be seen, therefore, that the present invention consists of an umbrella which is capable of automatically preventing the wind from lifting it from its socket or breaking the rib and brace mechanism due to the force on the canopy. Any extraordinary force of the wind is absorbed by the movement of the auxiliary post 17 upwardly and the hub 16 downwardly, thus reducing the effective area of the canopy presented to the wind.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Umbrella, comprising:

(a) a tubular main post, adapted to be mounted in the ground in a vertical position, (b) a generally circular foldable canopy carried above the upper end of the main post, (c) braces connecting the canopy to a hub that is slidably mounted on an intermediate portion of the post, (d) means for moving the hub vertically along the post from a high position where the canopy is raised to a low position where the canopy is folded, (e) an auxiliary post slidably mounted in the upper portion of the main post, the center of the canopy being connected to the upper end of the auxiliary post, and (f) a spring acting between the main post and the auxiliary post to resist upward movement of the auxiliary post when wind acts on the canopy.

2. Umbrella as recited in claim 1, wherein the auxiliary post is tubular, and wherein a guide post lies within the auxiliary post, is fastened at its lower end to the main post, and is keyed to the auxiliary post to permit sliding relative motion, but not relative rotational movement.

3. Umbrella as recited in claim 2, wherein a crank-operated windlass is mounted in the lower part of the main post, and wherein a cord extends from the windlass to the hub to move the hub from the low position to the high position and visa versa.

4. Umbrellas as recited in claim 3, wherein a pulley is mounted at the upper end of the main post to carry the cord up over the upper edge of the post and downwardly to the hub.

5. Umbrella as recited in claim 4, wherein a control rod passes slidably through a vertical bore in the hub, the rod having a stop at its lower end, the cord being attached to the upper end of the rod, and wherein a coil spring under tension surrounds the control rod is fixed at its upper end to the upper end of the control rod while its lower end is fixed to the hub, so that, when a strong wind strikes the canopy, the hub is pushed downwardly against the spring tension.

6. Umbrella as recited in claim 2, wherein the guide post is a tube of square cross-section and has its lower end fixed to a fixed plug fastened within the main post in its lower portion, a carrier plug is slidably carried in the lower part of the main post above the fixed plug, and wherein the lower end of the auxiliary post is fixedly attached to the carrier plug.

7. Umbrella as recited in claim 6, wherein a hub is mounted on the upper end of the auxiliary post and ribs are hingedly connected to the hub and extend radially outwardly therefrom to support the canopy.

* * * * *